US007292131B2

(12) United States Patent
Masuda

(10) Patent No.: US 7,292,131 B2
(45) Date of Patent: Nov. 6, 2007

(54) HEAT-SENSITIVE SWITCH AND A HEAT-SENSITIVE SWITCH ASSEMBLING METHOD

(75) Inventor: Masaji Masuda, Shizuoka (JP)

(73) Assignee: Fuji Electronics Industries Co., Ltd., Shizuoka-Shi, Shizuoka (JP)

( * ) Notice: Subject to any disclaimer, the term of this patent is extended or adjusted under 35 U.S.C. 154(b) by 283 days.

(21) Appl. No.: 10/971,019

(22) Filed: Oct. 25, 2004

(65) Prior Publication Data

US 2006/0061448 A1 Mar. 23, 2006

(30) Foreign Application Priority Data

Sep. 22, 2004 (JP) ..... 2004-274533

(51) Int. Cl.
*H01H 37/52* (2006.01)
*H01H 37/54* (2006.01)

(52) U.S. Cl. ..... 337/365; 337/362; 337/333; 337/342; 337/343

(58) Field of Classification Search ..... 337/395, 337/333, 342, 343, 362, 365
See application file for complete search history.

(56) References Cited

U.S. PATENT DOCUMENTS 3,096,417 A * 7/1963 Odenwald ..... 337/365
4,306,211 A * 12/1981 Hofsass ..... 337/89
4,470,033 A * 9/1984 Hofsass ..... 337/343
4,849,729 A * 7/1989 Hofsass ..... 337/102
5,745,022 A * 4/1998 Becher et al. ..... 337/104
5,828,286 A * 10/1998 Hofsass ..... 337/343
5,835,001 A * 11/1998 Hofsass ..... 337/104
5,864,278 A * 1/1999 Becher ..... 337/380
5,867,084 A * 2/1999 Hofsass ..... 337/349
5,892,429 A * 4/1999 Hofsass ..... 337/377
5,903,210 A * 5/1999 Hofsass ..... 337/342
5,973,587 A * 10/1999 Hofsass ..... 337/377
6,054,916 A * 4/2000 Hofsass ..... 337/344
6,064,295 A * 5/2000 Becher et al. ..... 337/349
6,100,784 A * 8/2000 Hofsass ..... 337/343
6,724,293 B1 * 4/2004 Hofsass ..... 337/365

FOREIGN PATENT DOCUMENTS

GB 2126421 A * 3/1984
JP 10-21805 1/1998

* cited by examiner

*Primary Examiner*—Anatoly Vortman
(74) *Attorney, Agent, or Firm*—McGinn IP Law Group, PLLC

(57) ABSTRACT

A heat-sensitive switch includes a first terminal, a second terminal away from the first terminal, a reverse spring reversing at a set temperature and having an opening part and positioned between the first and second terminals, and a junction spring positioned between the reverse spring and the second terminal without being fixed, integrally having a junction part protrusively positioned and in contact with the first terminal via the opening part, and also having an outer peripheral part in contact with the second terminal. An electric connection between the first and second terminals is formed, and when the reverse spring reverses at the set temperature, a force is applied to the junction part of the junction spring in the direction away from the first terminal, whereby the electric connection is cut.

8 Claims, 10 Drawing Sheets

RELATED ART

HEAT-SENSITIVE SWITCH AND A HEAT-SENSITIVE SWITCH ASSEMBLING METHOD

BACKGROUND OF THE INVENTION

1. Field of the Invention

The present invention relates to a heat-sensitive switch used for an electronic circuit, etc., and a method for assembling the heat-sensitive switch. More particularly, the present invention relates to the heat-sensitive switch for which welding of a junction spring on a base is no longer required, whereby the manufacturing and assembling can be facilitated.

2. Description of the Related Art

There is an example of a conventional heat-sensitive switch used for an electronic circuit, of which structure is as per illustrated in FIG. 18. FIG. 18(*a*) is a plan view showing an overall structure of the heat-sensitive switch, and FIG. 18(*b*) is a sectional view as seen by the line b-b of FIG. 18(*a*).

There is a chassis 201, in a shape of container having a bottom surface, comprising a bottom panel 203 and side walls 205. The chassis 201 has an upper opening part 207, which has been closed by a cover 209.

For the purpose of clarifying the inner structure, FIG. 18(*a*) does not illustrate the cover 209.

There are terminals 211, 213, respectively inserted and positioned on the left and right, inside the chassis 201.

There is a junction spring 215, incorporated and placed inside the chassis 201. An end of the junction spring 215 (the left end of FIG. 18) has been secured to a protrusive part 217 protruding from the bottom panel 203 of the chassis 201, and welded and fixed thereon in that state. Another end of the junction spring 215 (the right end of FIG. 18) has a junction part 219 provided on the lower surface.

There is also a reverse spring 221 under the junction spring 215, incorporated and placed inside the chassis 201. The reverse spring 221 comprises a so-called "bimetal" material.

According to the above structure, the heat-sensitive switch in normal state is as per shown in FIG. 18(*b*), wherein the junction part 219 of the junction spring 215 is in contact with the terminal 213. The other end of the junction spring 215 is also in contact with the terminal 211. Thus, the terminal 211 and the terminal 213 are electrically connected to each other.

Further, when the environmental temperature reaches a set temperature, which has been set in advance, the reverse spring 221 is reversed, and becomes in a form as shown by imaginary lines of FIG. 18(*b*), whereby the junction spring 215 is pressed upwardly. Consequently, the junction part 219 of the junction spring 215 moves away from the terminal 213, and the electric connection between the terminal 211 and the terminal 213 is cut.

On the other hand, when the once risen temperature goes down again, the reverse spring 221 returns to the original form, whereby the electric connection between the terminal 211 and the terminal 213 is resumed again.

Although having no direction relation, there is an analogous disclosure to the heat-sensitive switch of the present invention, such as in the Official Gazette of Japanese Unexamined Patent Publication No. Hei 10-21805.

However, the conventional heat-sensitive switch has a disadvantageous point.

According to the conventional structure, an end of the junction spring 215 should be welded and fixed on the side of the bottom panel 203 of the chassis 201, which requires a laborious assembling. In particular, the welding must be done after inserting the reverse spring 221 under the junction spring 215, which would cause poor working efficiency.

SUMMARY OF THE INVENTION

It is an object of the present invention to provide a heat-sensitive switch, and an assembling method of the heat-sensitive switch, for which welding of the junction spring is no longer required, whereby the manufacturing and assembling can be facilitated.

To achieve the object mentioned above, an exemplary embodiment of the present invention, there is provided a heat-sensitive switch, having a first terminal; a second terminal positioned away from the first terminal; a reverse spring, which reverses at a set temperature being set in advance, having an opening part and positioned between the first terminal and the second terminal; and a junction spring, positioned between the reverse spring and the second terminal without being fixed, integrally having a junction part protruded and positioned to be in contact with the first terminal via the opening part, and also having an outer peripheral part in contact with the second terminal, whereby an electric connection between the first terminal and the second terminal is formed, and when the reverse spring reverses at the set temperature, a force is applied to the junction part of the junction spring in the direction away from the first terminal, whereby the electric connection is cut.

According to another embodiment of the present invention, there is provided a heat-sensitive switch further characterized in that the junction spring has load characteristics, which increase from start of pressing to a peak load, and then decrease, and after reaching a minimum load, increase again.

According to another embodiment of the present invention, there is provided a heat-sensitive switch further characterized in that the junction spring is positioned between the reverse spring and the second terminal without being fixed, having a bridge part protruded and positioned in the shape of arch and provided with a center junction part at the center of the bridge part, and also having a pair of outer junction parts provided on the both sides of the bridge part via slits, each of the outer junction parts being provided with bent parts protrusively bent in the same direction as the protruding direction of the bridge part, so that the center junction part is protruded and positioned to be in contact with the first terminal via the opening part, and so that the outer junction parts are in contact with the second terminal, whereby the electric connection between the first terminal and the second terminal is formed.

According to yet another embodiment of the present invention, there is provided a heat-sensitive switch further characterized in that the outer junction part is comprising, a contact part in contact with the second terminal, and a pair of bent parts on the both sides of the contact part, each of the bent part being protrusively bent in the same direction as the protruding direction of the bridge part.

According to yet another embodiment of the present invention, there is provided a heat-sensitive switch further characterized in that the contact part is a flat part.

According to a further embodiment of the present invention, there is provided a heat-sensitive switch, further characterized in that the contact part is an arc part.

According to a further embodiment of the present invention, there is provided a heat-sensitive switch further characterized in that the contact part is not less than two arc parts.

According to an additional embodiment of the present invention, there is provided a heat-sensitive switch further characterized in that the second terminal has been incorporated in a chassis by insertion, and the first terminal has been incorporated, by insertion, in a cover which covers an opening part of the chassis.

According to a further embodiment of the present invention, there is provided an assembling method of heat-sensitive switch, including piling and placing a junction spring and a reverse spring in a chassis without fixing; and covering an opening part of the chassis by a cover.

According to yet a further embodiment of the present invention, there is provided an assembling method of heat-sensitive switch further characterized in that a second terminal has been incorporated in the chassis, in advance by insertion; and a first terminal has been incorporated in the cover, in advance by insertion.

As discussed above, the heat-sensitive switch according to the first embodiment of the present invention includes the first terminal; the second terminal positioned away from the first terminal; the reverse spring, which reverses at a set temperature being set in advance, having the opening part and positioned between the first terminal and the second terminal; and the junction spring, positioned between the reverse spring and the second terminal without being fixed, integrally having the junction part protruded and positioned to be in contact with the first terminal via the opening part, and also having the outer peripheral part in contact with the second terminal, whereby the electric connection between the first terminal and the second terminal is formed, and when the reverse spring reverses at the set temperature, the force is applied to the junction part of the junction spring in the direction away from the first terminal, whereby the electric connection is cut. With this structure, the welding of the junction spring, which has been required in the prior art, is no longer required, whereby the manufacturing and assembling can be facilitated.

Preferably, the junction spring may have the load characteristics, which increase from the start of pressing to the peak load, and then decrease, and after reaching the minimum load, increase again. With this structure, it is possible to set a lower load when the switch is turned OFF. Consequently, the effect to the reverse spring, due to the spring load of the junction spring, can be reduced, whereby the reverse spring can be returned with high accuracy, thus it is possible to improve the performance serving as the heat-sensitive switch.

Preferably, the heat-sensitive switch may have the structure that: the junction spring is positioned between the reverse spring and the second terminal without being fixed, having the bridge part protruded and positioned in the shape of arch and provided with the center junction part at the center of the bridge part, and also having the pair of outer junction parts provided on the both sides of the bridge part via the slits, each of the outer junction parts being provided with the bent parts protrusively bent in the same direction as the protruding direction of the bridge part, so that the center junction part is protruded and positioned to be in contact with the first terminal via the opening part, and so that the outer junction parts are in contact with the second terminal, whereby the electric connection between the first terminal and the second terminal is formed. With this structure, it is possible to obtain the junction spring surely and easily, having the characteristics, which increase from the start of pressing to the peak load, and then decrease, and after reaching the minimum load, increase again.

Preferably, the outer junction part may be comprising, the contact part in contact with the second terminal, and the pair of bent parts on the both sides of the contact part, each of the bent part being protrusively bent in the same direction as the protruding direction of the bridge part. With this structure, it is further possible to obtain the junction spring surely and easily, having the characteristics, which increase from the start of pressing to the peak load, and then decrease, and after reaching the minimum load, increase again.

Preferably, the contact part may be the flat part, the arc part, or not less than two arc parts.

Preferably, the second terminal may be incorporated in the chassis by insertion, and the first terminal may also be incorporated, by insertion, in the cover which covers the opening part of the chassis. With this structure, the number of assembly parts may be reduced further, whereby it is further possible to effectively facilitate the manufacturing and assembling.

Further, according to the assembling method of heat-sensitive switch of the present invention, the assembling can be facilitated, and it is also possible to cope with the automation effectively.

Preferably, the second terminal may be incorporated in the chassis, in advance by insertion, and the first terminal may also be incorporated in the cover, in advance by insertion similarly, and the further effective assembling can be accomplished.

BRIEF DESCRIPTION OF THE DRAWINGS

The invention will be described below in detail with reference to the accompanying drawings, in which.

DETAILED DESCRIPTION OF THE INVENTION

FIRST EMBODIMENT

Figure 1A:
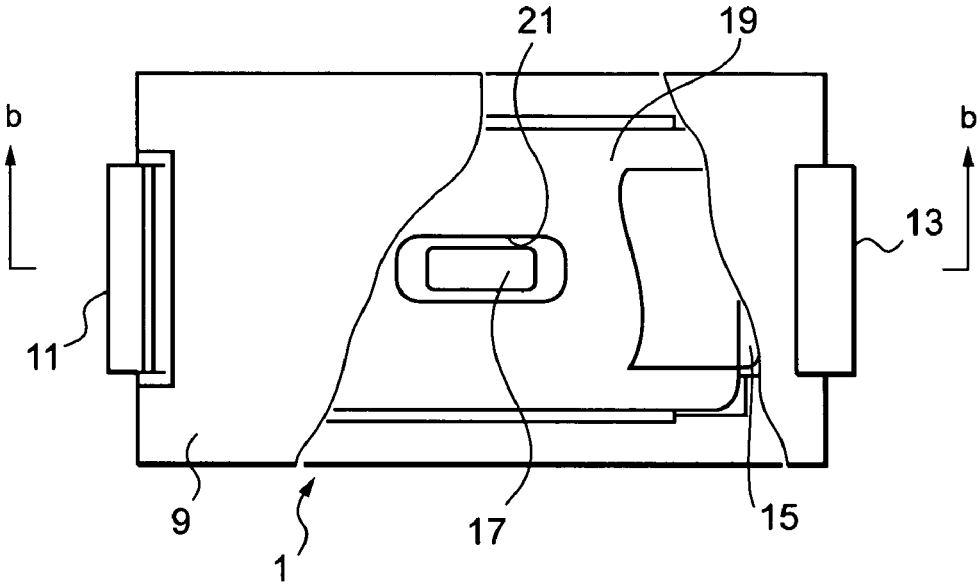
FIG. 1 has views showing a first embodiment of the present invention, in which, FIG. 1(*a*) is a plan view showing a structure of a heat-sensitive switch, and FIG. 1(*b*) is a sectional view as seen by the line b-b of FIG. 1(*a*)
Figure 1B:
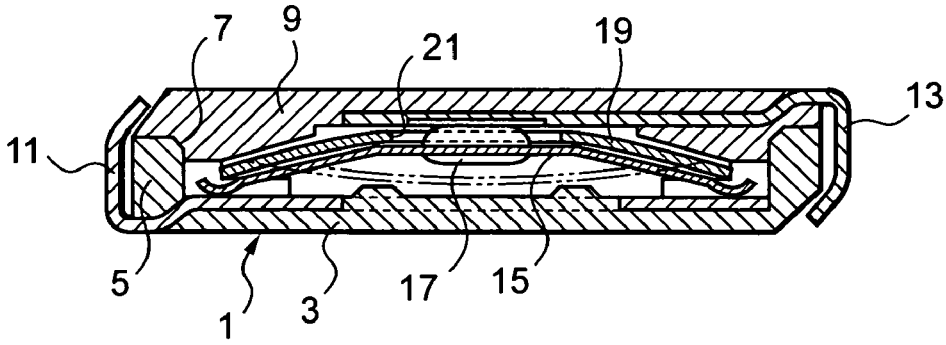

A first embodiment of the present invention will now be described with reference to FIG. 1. FIG. 1(*a*) is a plan view showing an overall structure of a heat-sensitive switch according to the present embodiment, and FIG. 1(*b*) is a sectional view as seen by the line b-b of FIG. 1(*a*).

There is a chassis 1, in a shape of container having a bottom surface, comprising a bottom panel 3 and side walls 5. The chassis 1 has an upper opening part 7, which has been closed by a cover 9.

For the purpose of reference, the cover 9 has been partially cut in FIG. 1(*a*).

There is a second terminal 11, integrally incorporated by insertion, in the bottom panel 3 of the chassis 1. There is also a first terminal 13, integrally incorporated by insertion, in the cover 9. Further, there is a junction spring 15 incorporated in the chassis 1. The junction spring 15 is provided with a junction part 17 at the center thereof. There is a reverse spring 19, comprising "bimetal" material, incorporated in the chassis 1 above the junction spring 15. The reverse spring 19 has an opening part 21 formed at the center thereof. The junction spring 15 and the reverse spring 19 have been placed, without being fixed by welding, etc.

The bottoms of the outer peripheral parts of the junction spring 15 are in contact with the second terminal 11. On the other hand, the junction part 17 of the junction spring 15 is protruded upwardly and positioned, via the opening part 21 of the reverse spring 19, to be in contact with the first terminal 13.

The function of the heat-sensitive switch according to the present embodiment will now be discussed, based on the above structure.

The normal state of the heat-sensitive switch is as shown in FIG. 1(*b*). The junction part 17 of the junction spring 15 is in contact with the first terminal 13, and the bottoms of the outer peripheral parts of the junction spring 15 are in contact with the second terminal 11. Thus, the second terminal 11 and the first terminal 13 is electrically connected to each other.

When the environmental temperature reaches a set temperature, which has been set in advance, the reverse spring 19 is reversed, and becomes in a form as shown by imaginary lines of FIG. 1(*b*), whereby the junction spring 15 is pressed downwardly. Consequently, the junction part 17 of the junction spring 15 moves away from the first terminal 13, and the electric connection between the second terminal 11 and the first terminal 13 is cut.

On the other hand, when the once risen temperature goes down again, the reverse spring 19 returns to the original form, whereby the electric connection between the second terminal 11 and the first terminal 13 is resumed again.

The present embodiment as discussed above has the following merits.

First, the manufacturing and assembling of the heat-sensitive switch can be facilitated, because the conventional welding of the junction spring is no longer required. According to the present embodiment, it is sufficient to simply place the junction spring 15 in the chassis 1.

Consequently, it is possible to reduce the time and work for manufacturing and assembling, whereby the production cost may also be reduced.

Second, according to the present embodiment, the second terminal 11 has been integrally incorporated in the chassis 1 by insertion, and similarly, the first terminal 13 has also been integrally incorporated in the cover 9 by insertion. Thus, the number of assembly parts can be reduced correspondingly, whereby the manufacturing and assembling may also be facilitated.

Third, in regard to the assembling of the heat-sensitive switch, where the second terminal 11 has been integrally incorporated in the chassis 1 in advance by insertion, and where the first terminal 13 has also been integrally incorporated in the cover 9 in advance by insertion, it is sufficient to simply pile and place the junction springs 15 and the reverse spring 19 inside the chassis 1, and thereafter, to simply close the opening part 7 by the cover 9. Therefore, the assembling is remarkably simple, and it is also possible to cope with the automation easily.

SECOND EMBODIMENT

Figure 2:
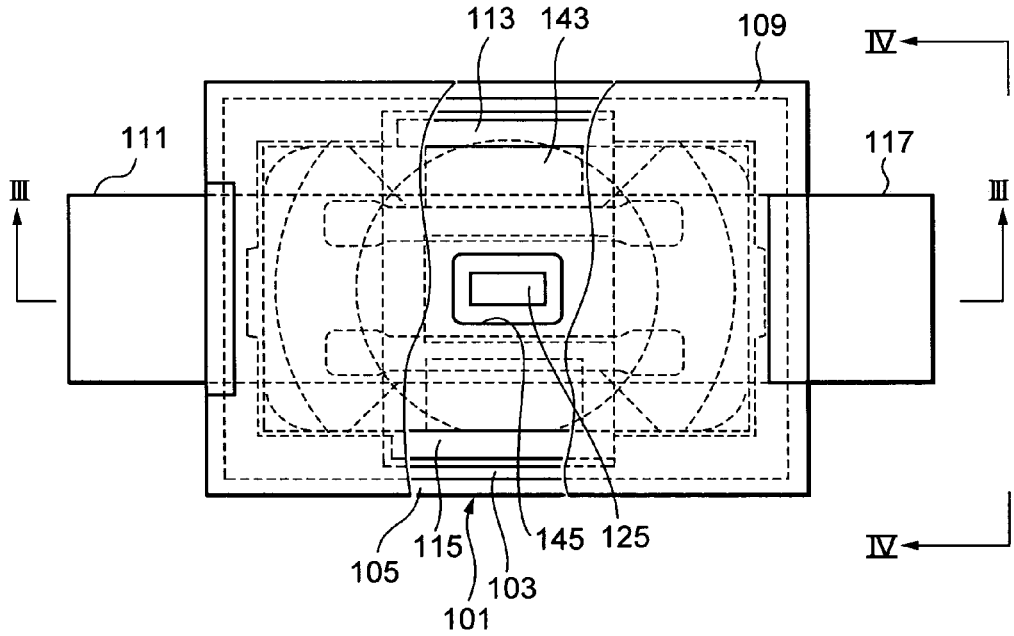
FIG. 2 is a plan view showing a structure of a heat-sensitive switch according to a second embodiment.
Figure 3:
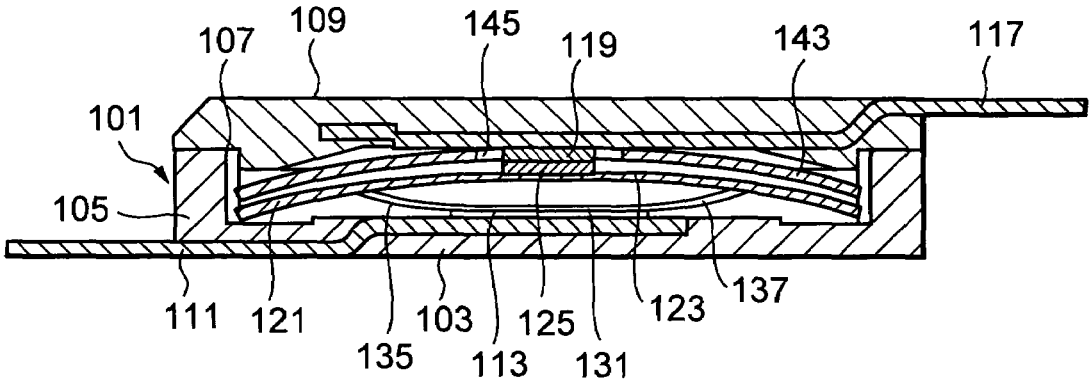
FIG. 3 is a sectional view as seen by the line III-III of FIG. 2, according to the second embodiment of the present invention.
Figure 4:
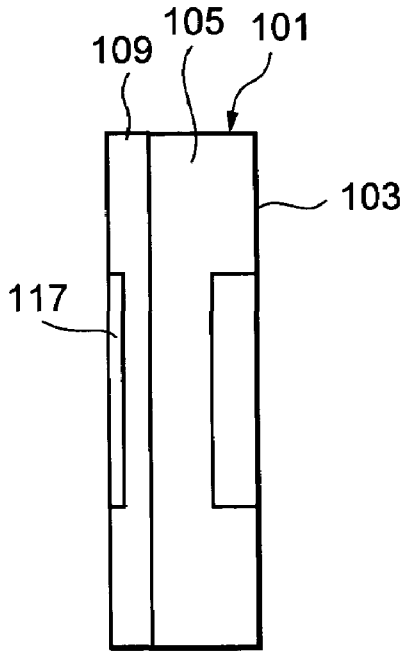
FIG. 4 is a view as seen by an arrow IV-IV of FIG. 2, according to the second embodiment of the present invention.

A second embodiment of the present invention will now be described with reference to FIGS. 2 through 14. FIG. 2 is a plan view showing an overall structure of a heat-sensitive switch according to the present embodiment, FIG. 3 is a sectional view as seen by the line III-III of FIG. 2, and FIG. 4 is a view as seen by an arrow IV-IV of FIG. 2.

There is a chassis 101, in a shape of container having a bottom surface, comprising a bottom panel 103 and side walls 105. The chassis 101 has an upper opening part 107, which has been closed by a cover 109.

For the purpose of reference, the cover 109 has been partially cut in FIG. 2.

Figure 5:
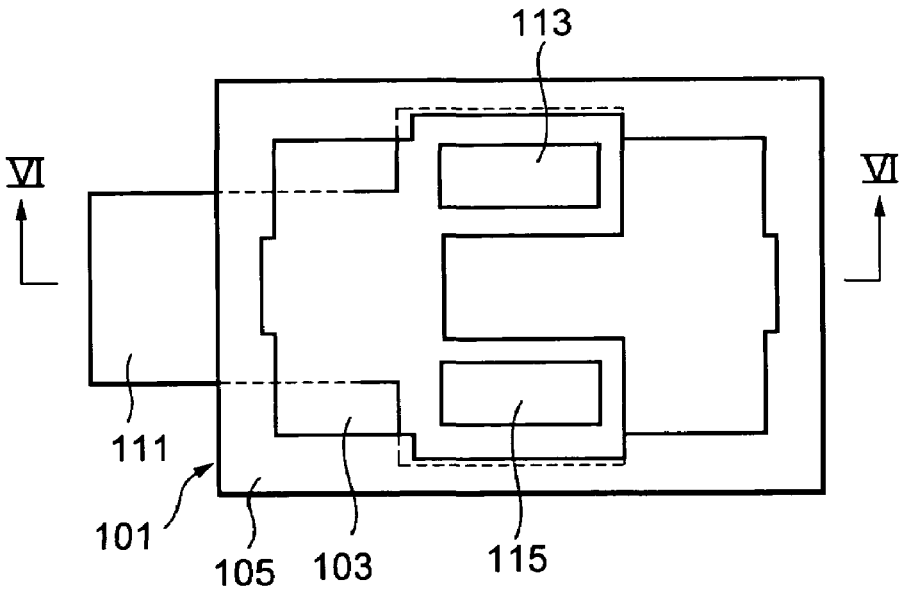
FIG. 5 is a plan view showing a structure of a base part according to the second embodiment of the present invention.
Figure 6:
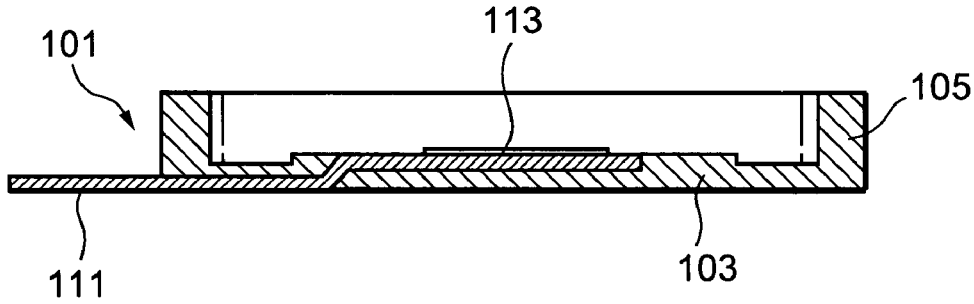
FIG. 6 is a sectional view as seen by the line VI-VI of FIG. 5, according to the second embodiment of the present invention.

There is a second terminal 111, integrally incorporated by insertion, in the bottom panel 103 of the chassis 101. FIGS. 5 and 6 illustrate only the part of the bottom panel 103. As illustrated in FIGS. 5 and 6, the second terminal 111 has been integrally incorporated in the bottom panel 103, from the left of FIGS. 5 and 6, and has two junction parts 113, 115, in the upper and lower portions as shown in FIG. 5. The reason for providing these two junction parts 113, 115, in the upper and lower portions as shown in FIG. 5, is as follows. If there are two junction parts, provided in the right and left portions of FIG. 5, the length of the panel member as the structural material should become longer, and the cut part during pressing should be increased, which would result in the poor yield. On the other hand, as discussed above, when there are two junction parts 113, 115, provided in the upper and lower portions of FIG. 5, the length of the panel member may become shorter, and the cut part during pressing may also be reduced, which may contribute to the good yield.

Figure 13:
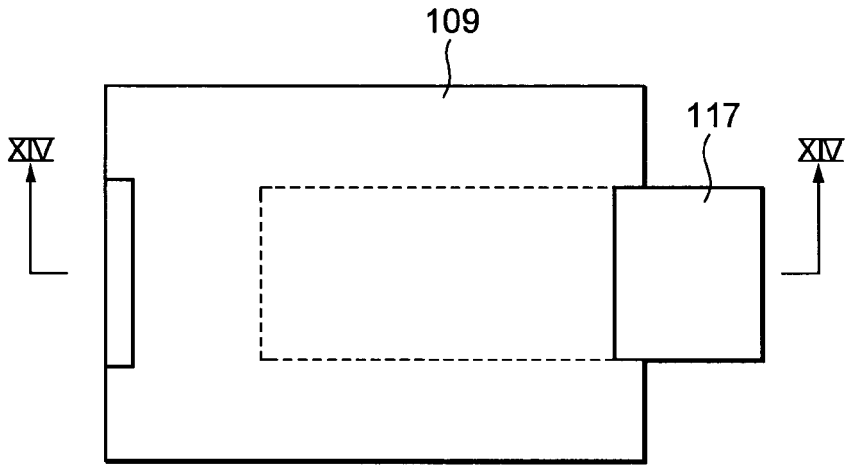
FIG. 13 is a plan view showing a structure of a cover according to the second embodiment of the present invention.
Figure 14:
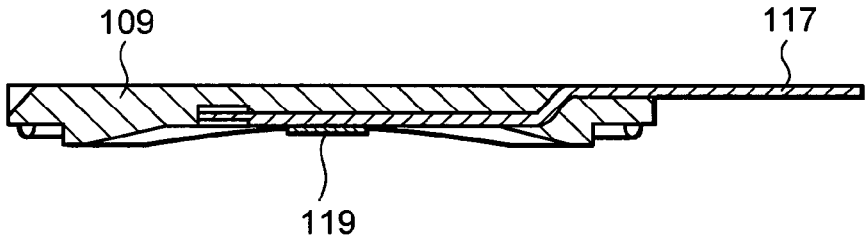
FIG. 14 is a sectional view as seen by the line XIV-XIV of FIG. 13, according to the second embodiment of the present invention.

There is also a first terminal 117, integrally incorporated by insertion, in the cover 109. FIGS. 13 and 14 illustrate only the part of the cover 109. The first terminal 117 has been integrally incorporated in the cover 109 from the right of FIGS. 13 and 14, and there is a junction part 119 provided at the center on the bottom surface of the first terminal 117.

Figure 7:
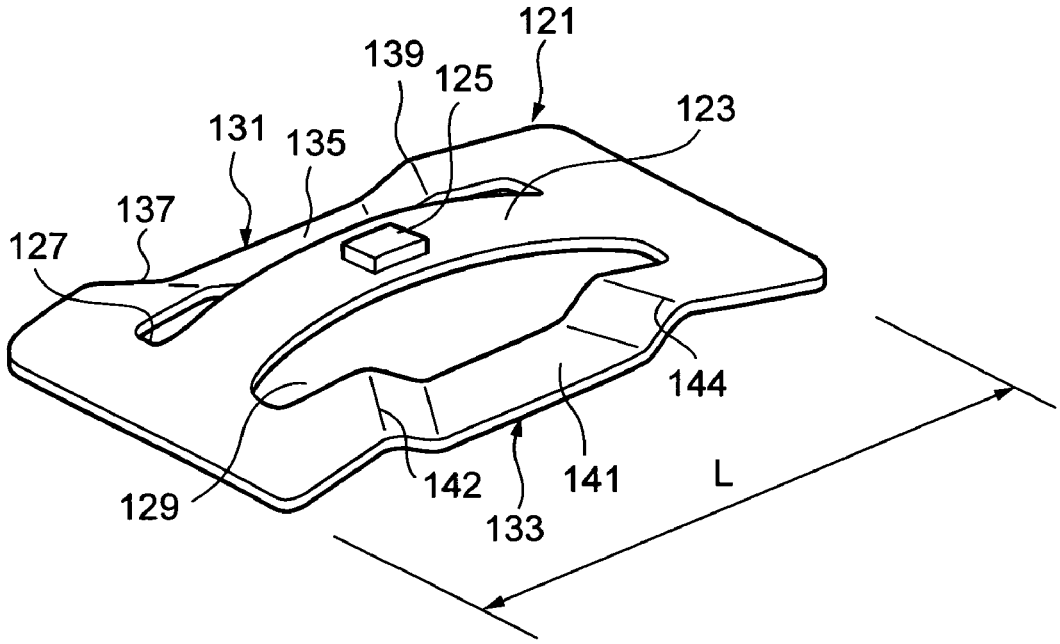
FIG. 7 is a perspective view showing a structure of a junction spring according to the second embodiment of the present invention.
Figure 8:
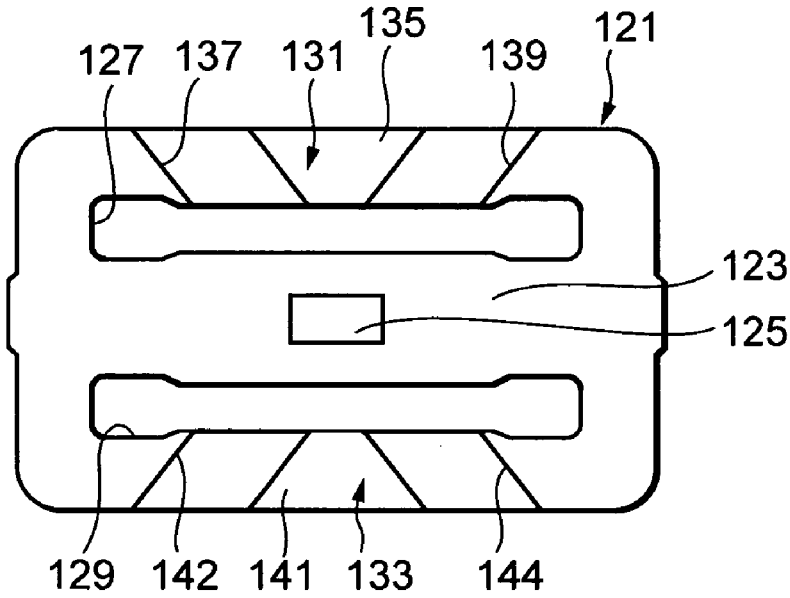
FIG. 8 is a plan view of the junction spring according to the second embodiment of the present invention.

Further, there is a junction spring 121 incorporated in the chassis 101. The structure of the junction spring 121 is as per illustrated in FIGS. 7 through 9. There is a bridge part 123 in the shape of protrusive arch, provided at the center of the junction spring 121. There is a center junction part 125 provided at the center on the upper surface of the bridge part 123. There are slits 127, 129, respectively provided in the upper and lower sides of the bridge part 123 as shown in FIG. 8. Further, there are outer junction parts 131, 133 provided on the outer sides of the slits 127, 129. The outer junction part 131 comprises, a flat part 135, and bent parts 137, 139, respectively provided on the left and right of the flat part 135 as shown in FIG. 8. The bent parts 137, 139 are protrusively bent in the same direction as the protruding direction of the bridge part 123. Similarly, the outer junction part 133 comprises, a flat part 141, and bent parts 142, 144, respectively provided on the left and right of the flat part 141 as shown in FIG. 8. The bent parts 142, 144 are also protrusively bent in the same direction as the protruding direction of the bridge part 123.

With regard to forming of the junction spring 121 as discussed above, first, after forming the pair of slits 127, 129, the bent parts 137, 139, 142, 144, on the left and right, are formed. Thus, the length (L) as shown in FIG. 7 becomes shorter than that before these bent parts are bent, and at the same time, the bridge part 123 at the center is formed in the protrusive shape.

For reference, the reason why the junction spring 121 has the above shape, will be discussed afterwards.

Figure 11:
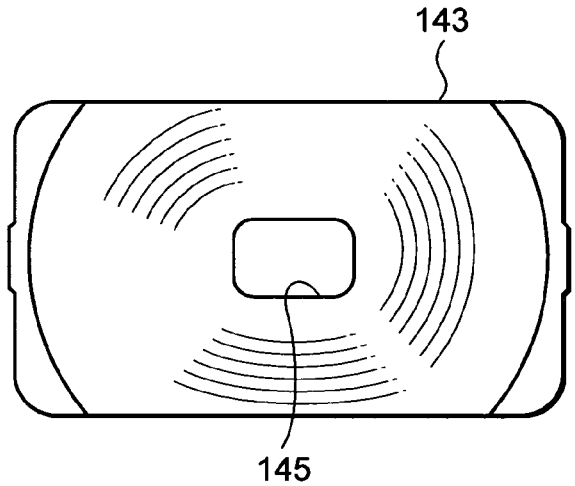
FIG. 11 is a plan view showing a structure of a reverse spring according to the second embodiment of the present invention.
Figure 12:
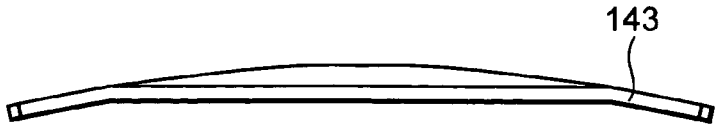
FIG. 12 is a side view showing the structure of the reverse spring according to the second embodiment of the present invention.

Now referring back to FIG. 3, there is a reverse spring 143, incorporated in the chassis 101 above the junction spring 121. The reverse spring has the shape as shown in FIGS. 11 and 12, comprising "bimetal" material. The reverse spring 143 has an opening part 145 formed at the center thereof. The junction spring 121 and the reverse spring 143 have been placed, without being fixed by welding, etc.

The outer junction parts 131, 133 of the junction spring 121 are in contact with the junction parts 113, 115 of the second terminal 111. On the other hand, the junction part 125 of the junction spring 121 is protruded upwardly and positioned, via the opening part 145 of the reverse spring 143, to be in contact with the junction part 119 of the first terminal 117.

Figure 9:
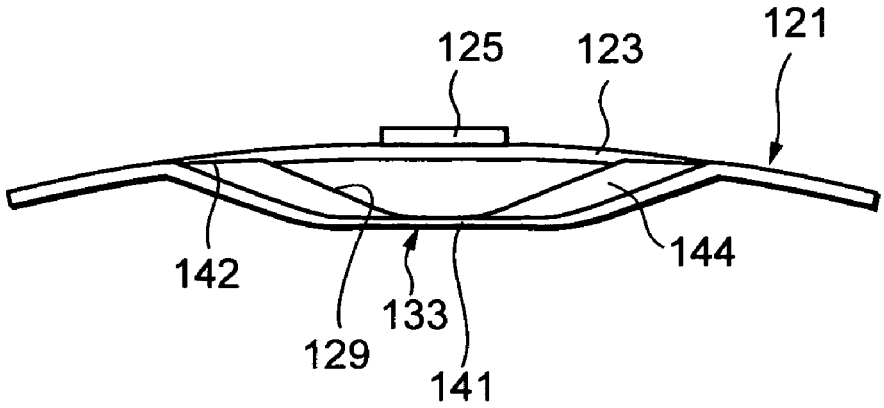
FIG. 9 is a side view showing the structure of the junction spring according to the second embodiment of the present invention.
Figure 10:
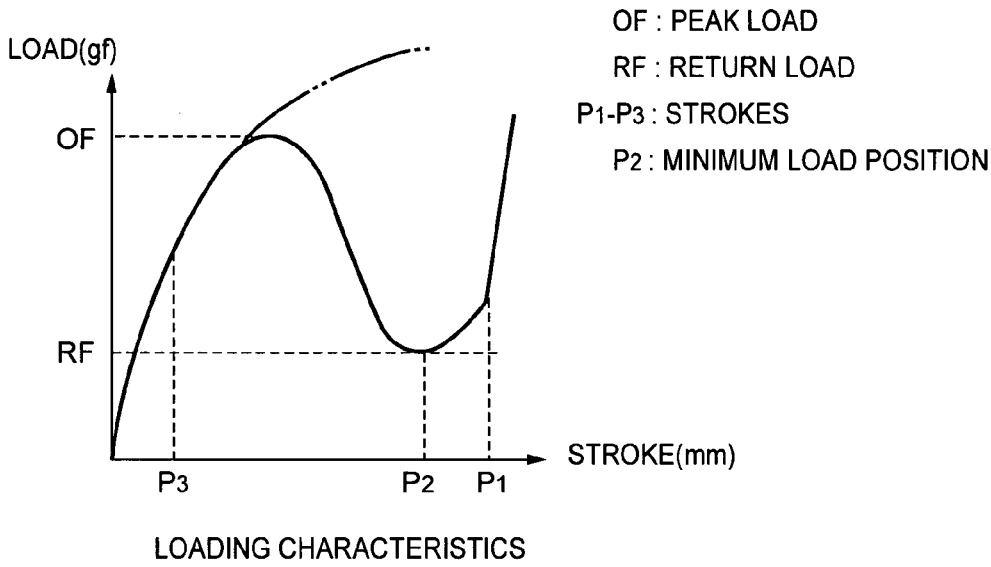
FIG. 10 is a characteristic chart showing the load characteristics of the junction spring according to the second embodiment of the present invention.

Now the reason why the junction spring 121 has the shape as shown in FIGS. 7 through 9, will be explained with reference to FIG. 10. FIG. 10 is a characteristic chart showing the load characteristics of the junction spring 121, in which, the stroke (mm) is shown by the horizontal axis, and the load (g) is shown by the vertical axis, in order to show the change of loading characteristics. In regard to the measurement, the load was given downwardly to the center of the junction spring 121, and the displacement of the junction spring 121 was measured.

As a result, the loading characteristics as illustrated by the solid line of FIG. 10 were obtained. According to the loading characteristics, when the pressing stroke increased gradually, the junction spring 121 is pressed downwardly, and the form was changed gradually. Correspondingly, the load also increased gradually, and reached the peak load (OF). When the pressing stroke increased further, then the load decreases gradually, and reached the return load (RF), and thereafter, the load increased again. According to the present embodiment, the reason why the junction spring 121 has the shape as shown in FIGS. 7 through 9, is because of obtaining the load characteristics as illustrated in FIG. 10.

The actual motion of the present embodiment will be discussed based on the above load characteristics. When the heat-sensitive switch is turned ON, the junction spring 121 has been slightly pressed by the reverse spring 143. This state is shown as the point P3 of the characteristic curve of FIG. 10. In this state, when the environmental temperature changes, the reverse of the reverse spring 143 is started, and consequently, the heat-sensitive switch is turned OFF, and at the same time, the junction spring 121 is pressed downwardly by the reverse spring 143. In that state, the load characteristics change as shown in FIG. 10. Thereafter, the junction spring 121 passes through the minimum load position P2, and eventually stops at the point P1 of FIG. 10, whereby the OFF state of the heat-sensitive switch is maintained.

Although the load at the point P1 directly gives an effect to the reverse spring 143, this effect is very small as compared with the prior art. Thus, when the environmental temperature changes again and the return spring 143 returns to the original form, the effect by the load as discussed above is also small. Therefore, the effect of the reverse spring to the temperature characteristic is small, whereby the reverse and return motion of the reverse spring 143 may be done accurately according to the set value. Consequently, it is possible to improve the performance serving as the heat-sensitive switch.

For reference, the load characteristics of the heat-sensitive switch according to the prior art are shown by the imaginary line of FIG. 10, in which, the larger load is still given when the heat-sensitive switch is turned OFF. Consequently, at the time of reverse motion, there is still a considerable effect of such a larger load to the reverse spring, which would deteriorate the temperature characteristic of the reverse spring.

The function of the heat-sensitive switch according to the present embodiment will now be discussed, based on the above structure.

The normal state of the heat-sensitive switch is as shown in FIG. 3. The junction part 125 of the junction spring 121 is in contact with the junction part 119 of the first terminal 117. Further, the bottoms of the outer peripheral parts of the junction spring 121 are in contact with the junction parts 113, 115 of the second terminal 111. Thus, the second terminal 111 and the first terminal 117 is electrically connected to each other.

On the other hand, when the environmental temperature reaches a set temperature, which has been set in advance, the reverse spring 143 is reversed in the downward direction of FIG. 3, and presses the junction spring 121 downwardly. Consequently, the junction part 125 of the junction spring 121 moves away from the junction part 119 of the first terminal 117, and the electric connection between the second terminal 111 and the first terminal 117 is cut.

At that time, the reverse spring 143 is reversed downwardly, and correspondingly, the junction spring 121 is also warped downwardly. Further, the return spring force of the junction spring 121 is applied to the reverse spring 143. According to the present embodiment, as illustrated in FIG. 10, since the junction spring 121 has been formed in a shape in which the return spring force should be minimized, there is a small effect to the next return motion of the reverse spring 143.

When the once risen temperature goes down again, the reverse spring 143 returns to the original form, whereby the electric connection between the second terminal 111 and the first terminal 117 is resumed again. As discussed above, since the return spring force of the junction spring 121 applied to the reverse spring 143 is small, the reverse spring 143 is not affected by such a return spring force, and makes the return motion accurately.

For reference, when there is a large return spring force of the junction spring 121 applied to the reverse spring 143, the reverse spring 143 will be affected by that return spring force, and makes the earlier return motion than that according to its own temperature characteristic, which would eventually deteriorate the performance serving as the heat-sensitive switch.

The present embodiment as discussed above has the following merits.

First, the manufacturing and assembling of the heat-sensitive switch can be facilitated, because the conventional welding of the junction spring is no longer required. According to the present embodiment, it is sufficient to simply place the junction spring 121 in the chassis 101.

Consequently, it is possible to reduce the time and work for manufacturing and assembling, whereby the production cost may also be reduced.

Second, according to the present embodiment, the second terminal 111 has been integrally incorporated in the chassis 101 by insertion, and similarly, the first terminal 117 has also been integrally incorporated in the cover 109 by insertion. Thus, the number of assembly parts can be reduced correspondingly, whereby the manufacturing and assembling may also be facilitated.

Third, in regard to the assembling of the heat-sensitive switch, where the second terminal 111 has been integrally incorporated in the chassis 101 in advance by insertion, and where the first terminal 117 has also been integrally incorporated in the cover 109 in advance by insertion, it is sufficient to simply pile and place the junction springs 121 and the reverse spring 143 inside the chassis 101, and thereafter, to simply close the opening part 107 by the cover 109. Therefore, the assembling is remarkably simple, and it is also possible to cope with the automation easily.

Fourth, since the return spring force of the junction spring 121 applied to the reverse spring 143 is small, the reverse spring 143 is not affected by such a return spring force, and makes the accurate return motion according to its own temperature characteristic. Thus, it is possible to improve the performance serving as the heat-sensitive switch.

Fifth, as the second terminal 111 has two junction parts 113, 115, provided in the upper and lower portions of FIG. 5, the length of the panel member may become shorter, and the cut part during pressing may also be reduced, which may contribute to the good yield.

THIRD EMBODIMENT

Figure 15:
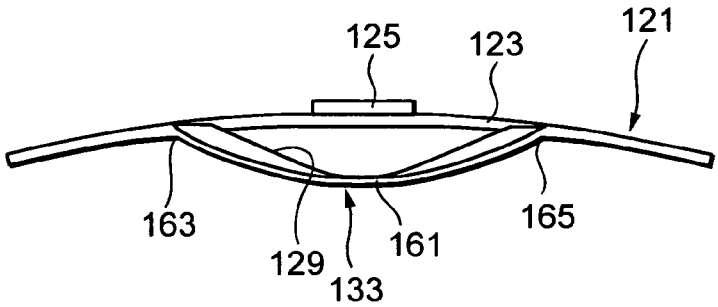
FIG. 15 is a side view of a junction spring according to a third embodiment of the present invention.

A third embodiment of the present invention will now be described with reference to FIG. 15. According to the third embodiment, there is another type of junction spring 121, of which shape is different from the junction spring 121 of the second embodiment. As illustrated in FIGS. 7 through 9, according to the second embodiment, the outer junction part 131 comprises, the flat part 135, and the bent parts 137, 139, and similarly, the outer junction part 133 comprises, the flat part 141, and the bent parts 142, 144. On the other hand, according to the third embodiment, each of the outer junction parts 131, 133 has an arc part, instead of the flat part. As illustrated in FIG. 15, the outer junction part 133 comprises, an arc part 161, and bent parts 163, 165 on the both sides of the arc part 161. The other outer junction part 131, although not illustrated, has substantially the same structure.

The other structure is substantially the same as that of the second embodiment, so the identical reference numerals are given to the identical parts, and the detailed explanation will not be done here.

According to the structure of the present embodiment, substantially the same effect as that of the second embodiment may be obtained.

FOURTH EMBODIMENT

Figure 16:
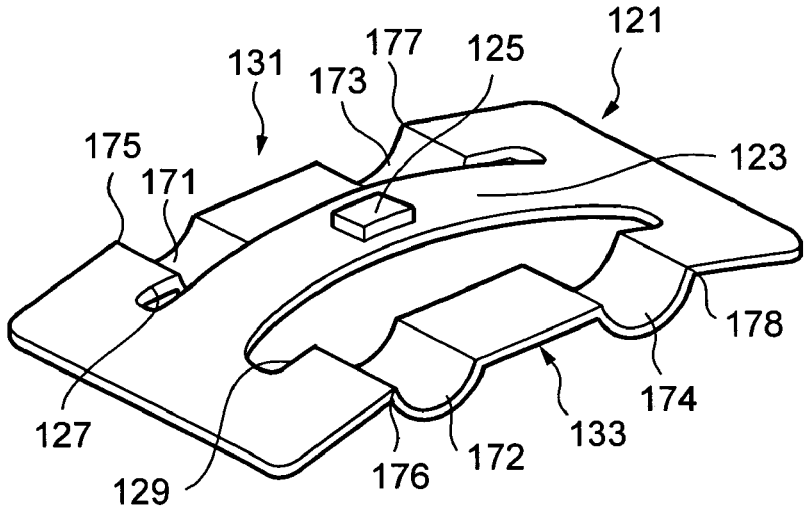
FIG. 16 is a perspective view of a reverse spring according to a fourth embodiment of the present invention.

A fourth embodiment of the present invention will now be described with reference to FIG. 16. According to the fourth embodiment, there is also another type of junction spring 121, of which shape is still different from the junction spring 121 of the second embodiment. As illustrated in FIGS. 7 through 9, according to the second embodiment, the outer junction part 131 comprises, the flat part 135, and the bent parts 137, 139, and similarly, the outer junction part 133 comprises, the flat part 141, and the bent parts 142, 144. On the other hand, according to the fourth embodiment, each of the outer junction parts 131, 133 has two arc parts, instead of the flat part. As illustrated in FIG. 16, the outer junction part 131 comprises, two arc parts 171, 173, and bent parts 175, 177 on the both sides of the arc parts 171, 173. Similarly, the outer junction part 133 comprises, two arc parts 172, 174, and bent parts 176, 178 on the both sides of the arc parts 172, 174.

The other structure is substantially the same as that of the second embodiment, so the identical reference numerals are given to the identical parts, and the detailed explanation will not be done here.

According to the structure of the present embodiment, substantially the same effect as that of the second embodiment may be obtained.

FIFTH EMBODIMENT

Figure 17:
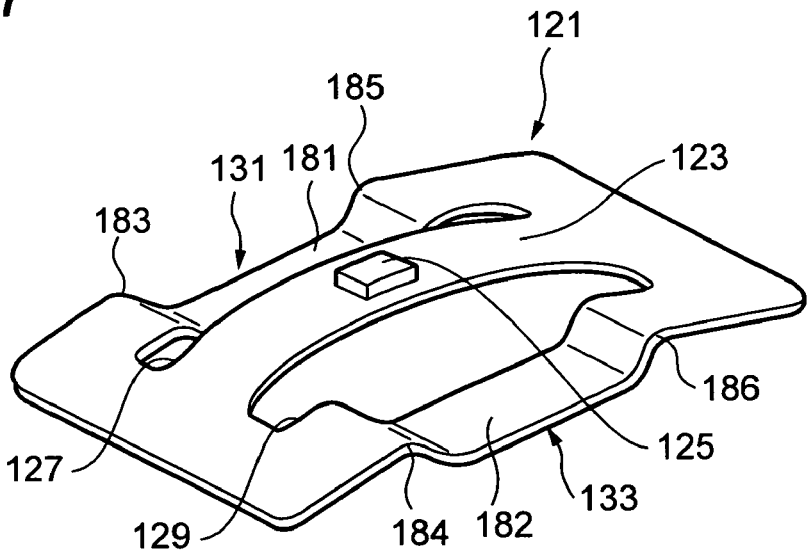
FIG. 17 is a perspective view of a reverse spring according to a fifth embodiment of the present invention.
Figure 18A:
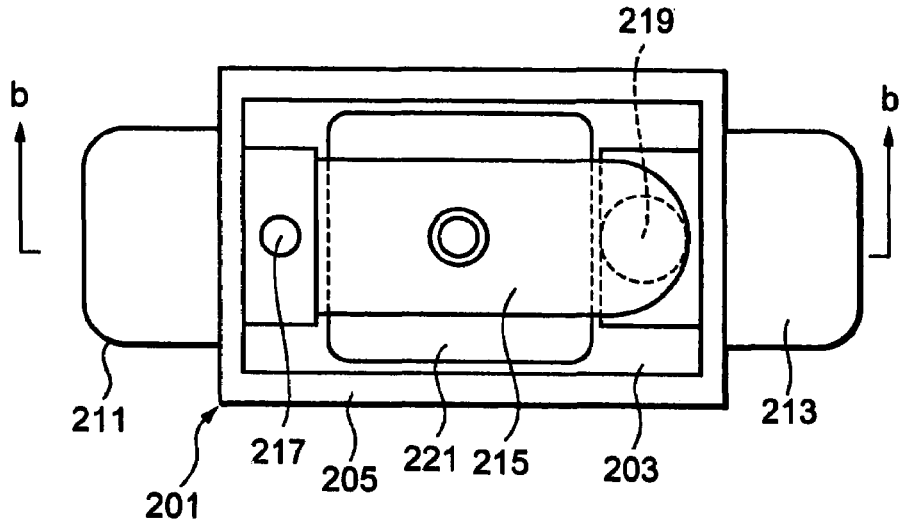
FIG. 18 has views showing a prior art, in which, FIG. 18(*a*) is a plan view showing a structure of a heat-sensitive switch, and FIG. 18(*b*) is a sectional view as seen by the line b-b of FIG. 18(*a*).
Figure 18B:
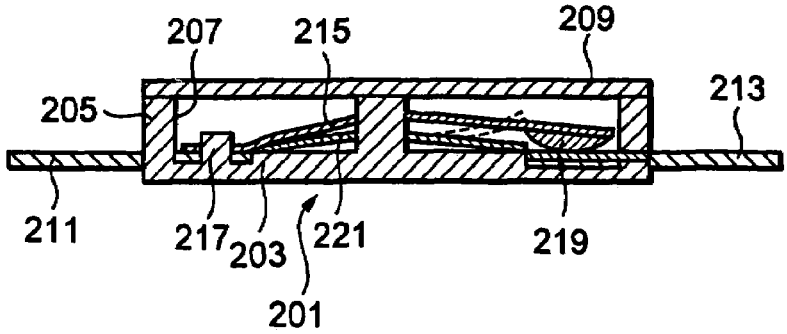
RELATED ART FIG. 18(b)

A fifth embodiment of the present invention will now be described with reference to FIG. 17. According to the fifth embodiment, the outer junction part 131 comprises, a flat part 181, and bent parts 183, 185 on the both sides of the flat part 181. The inside (i.e. the bottom surface side) of the each of the bent parts 183, 185 has been bent in the downward direction, at an angle closer to the vertical axis than that of the second embodiment. Similarly, the outer junction part 133 comprises, a flat part 182, and bent parts 184, 186 on the both sides of the flat part 182. The inside (i.e. the bottom surface side) of the each of the bent parts 184, 186 has been bent in the downward direction, at an angle closer to the vertical axis than that of the second embodiment.

The other structure is substantially the same as that of the second embodiment, so the identical reference numerals are given to the identical parts, and the detailed explanation will not be done here.

According to the structure of the present embodiment, substantially the same effect as that of the second embodiment may be obtained.

The present invention is not limited to the first through fifth embodiments as discussed above, and any modification and alteration may be done without departing the spirit of the present invention.

For example, according to the first through fifth embodiments, the second terminal 11 (or 111) has been integrally incorporated in the chassis 1 (or 101) by insertion, and the first terminal 13 (or 117) has also been integrally incorporated in the cover 9 (or 109) by insertion. However, the present invention is not limited to that structure.

Further, there may be various structures of the junction spring 21 (or 121) provided with desired load characteristics, other than those as illustrated in the present embodiments.

The shape of each part is not limited to that as illustrated in the drawings of the present invention, and any modification and alteration may be done without departing the spirit of the present invention.

What is claimed is:

1. A heat-sensitive switch, comprising:

a first terminal;

a second terminal positioned away from said first terminal;

a reverse spring, which reverses at a set temperature being set in advance, having an opening part and positioned between said first terminal and said second terminal; and a junction spring, positioned between said reverse spring and said second terminal without being fixed, integrally having a junction part that passes through the junction spring and is protruded and positioned to be in contact with said first terminal via said opening part, and also having an outer peripheral part in contact with said second terminal, whereby an electric connection between said first terminal and said second terminal is formed, and when said reverse spring reverses at said set temperature, a force is applied to said junction part of said junction spring in the direction away from said first terminal, whereby said electric connection is cut, wherein said junction spring is positioned between said reverse spring and said second terminal without being fixed, having a bridge part protruded and positioned in the shape of arch and provided with a center junction part at the center of said bridge part, and also having a pair of outer junction parts provided on the both sides of said bridge part via slits, each of said outer junction parts being provided with bent parts protrusively bent in the same direction as the protruding direction of said bridge part, so that said center junction part is protruded and positioned to be in contact with said first terminal via said opening part, and so that said outer junction parts are in contact with said second terminal, whereby said electric connection between said first terminal and said second terminal is formed.

2. The heat-sensitive switch as claimed in claim 1, wherein said junction spring has load characteristics, which increase from start of pressing to a peak load, and then decrease, and after reaching a minimum load, increase again.

3. The heat-sensitive switch as claimed in claim 1, wherein said outer junction part comprises:

a contact part in contact with said second terminal, and a pair of bent parts on the both sides of said contact part, each of said bent part being protrusively bent in the same direction as the protruding direction of said bridge part.

4. The heat-sensitive switch as claimed in claim 1, wherein said contact part comprises a flat part.

5. The heat-sensitive switch as claimed in claim 1, wherein said contact part comprises an arc part.

6. The heat-sensitive switch as claimed in claim 1, wherein said contact part comprises not less than two arc parts.

7. The heat-sensitive switch as claimed in claim 1, wherein said second terminal has been incorporated in a chassis by insertion, and said first terminal has been incorporated, by insertion, in a cover which covers an opening part of said chassis.

8. An assembling method of heat-sensitive switch, comprising:

forming a junction spring having a protruding bridge part in an arc shape, including a center junction part at a center of said protruding bridge part and a pair of outer junction parts provided on a top and a bottom surface of said protruding bridge part;

bending said outer junction parts to form bent parts protrusively bent in a same direction as a protruding direction of said protruding bridge part;

piling and placing a junction spring and a reverse spring in a chassis without fixing;

incorporating a second terminal in said chassis, in advance by insertion;

incorporating a first terminal in said cover, in advance by insertion;

positioning said junction spring between said reverse spring and said second terminal; and covering an opening part of said chassis by a cover.

* * * * *